United States Patent [19]

Brown et al.

[11] Patent Number: 4,579,258

[45] Date of Patent: Apr. 1, 1986

[54] OPERATING HANDLE FOR AEROSOL CONTAINER

[76] Inventors: Philip M. Brown, 1222 Coit; Richard S. Podgorski, Rte. 5, Box 117, both of Denton, Tex. 76201

[21] Appl. No.: 542,530

[22] Filed: Oct. 17, 1983

[51] Int. Cl.[4] ..... B65D 83/14; A47G 19/14

[52] U.S. Cl. ..... 222/323; 222/402.15; 222/473

[58] Field of Search ..... 222/402.1, 402.12, 402.15, 222/505, 509, 175, 182, 323, 465, 472, 473; 239/282; 285/236

[56] References Cited

U.S. PATENT DOCUMENTS

| | | | |
|---|---|---|---|
| 2,720,422 | 10/1955 | Mercur | 222/174 |
| 2,893,606 | 7/1959 | Hawkins | 222/174 |
| 2,960,260 | 11/1960 | Kutik | 222/473 |
| 3,045,878 | 7/1962 | Blanford et al. | 222/473 |
| 3,112,849 | 12/1963 | Wallace | 222/402.15 |
| 3,229,858 | 1/1966 | Lesh | 222/174 |
| 3,229,859 | 1/1966 | Conroy et al. | 222/402.15 |
| 3,359,017 | 12/1967 | Schaub | 285/236 |
| 3,933,377 | 1/1976 | Arrowood | 285/236 X |
| 4,089,440 | 5/1978 | Lee | 222/174 |
| 4,092,000 | 5/1978 | Offutt | 222/174 |
| 4,401,240 | 8/1983 | Brack | 222/323 |
| 4,413,756 | 11/1983 | Kirley | 222/402.11 |

FOREIGN PATENT DOCUMENTS

| | | | |
|---|---|---|---|
| 1117245 | 2/1956 | France | 239/282 |

*Primary Examiner*—F. J. Bartuska
*Assistant Examiner*—Michael S. Huppert
*Attorney, Agent, or Firm*—Glaser, Griggs & Schwartz

[57] ABSTRACT

An operating handle for an aerosol container features a hand grip portion, a shell portion and a trigger assembly interconnecting the hand grip portion and the shell portion. The trigger assembly includes an actuator arm for engaging the plunger head of an aerosol container and a trigger arm projecting along the hand grip portion whereby the trigger arm can be squeezed toward the hand grip portion to drive the actuator arm against the plunger head. The shell portion serves as a receptacle in which the aerosol can is secured and as a shield for isolating the hand and fingers from exposure to the aerosol spray. A quick release fastener assembly is carried by the shell portion for securing the aerosol container in a stable, upright operating position within the shell.

3 Claims, 5 Drawing Figures

OPERATING HANDLE FOR AEROSOL CONTAINER

BACKGROUND OF THE INVENTION

1. Field of the Invention:

The invention relates generally to hand operated appliances and in particular to an operating handle attachment for an aerosol container.

2. Description of the Prior Art

Conventional aerosol spray containers make it possible to apply a variety of spray materials such as paint, hair preparations, insecticides, herbicides, disinfectants and other such materials, some of which may be toxic. According to the usual method of applying a spray material from an aerosol container, the aerosol container is held in one hand with the forefinger of that hand being applied against the plunger head. This procedure exposes the hand and fingers to direct contact with the aerosol spray. The aerosol mixture, as it is discharged through the spray jet, produces an extremely cold spray which causes numbness and discomfort. Additionally, because of the awkward hand position required to operate the plunger head, the forefinger can become cramped during long duration spray applications.

Handle devices are known which attach to various parts of the aerosol can. A trigger mechanism is usually provided in such devices for depressing the plunger head of the aerosol can. However, such handle devices have not provided a comfortable, secure hold onto the aerosol container to permit it to be shaken, from time to time, to keep the aerosol contents mixed for effective delivery by the pressurized propellant. Additionally, none of the conventional handle devices provide a shield structure for preventing the exposure of the operator to the aerosol spray.

OBJECTS OF THE INVENTION

A general object of this invention is to provide an operating handle for an aerosol container which will provide for manual operation of the aerosol spray container while shielding the operator from exposure to the aerosol spray material and to avoid exposure of the operator to the extreme cold of the aerosol spray.

Another object of the invention is to provide an operating handle for an aerosol container which provides a stable, secure hold onto the container so that it can be shaken from time to time by hand movement of the operating handle to keep the aerosol contents mixed for effective delivery by the pressurized propellant.

Yet another object of the invention is to provide a lightweight, balanced operating handle for an aerosol spray container which provides a comfortable grip for the operator whereby the operator can apply the aerosol spray uniformly in sweeping motions.

A related object of the invention is to provide an operating handle for an aerosol container having a hand grip and actuating trigger assembly which can be grasped and operated while the hand is in a comfortable, natural position for long duration applications, thereby avoiding finger cramp.

Another object of the invention is to provide an operating handle which can accomodate aerosol spray containers of different sizes, in which the spray container can be attached and operated manually without tools.

SUMMARY OF THE INVENTION

An operating handle for an aerosol container features a hand grip portion, a shell portion and a trigger assembly. The trigger assembly includes a housing portion which interconnects the hand grip portion and the shell portion. The trigger assembly includes an actuator arm for engaging the plunger head of an aerosol container and a trigger arm projecting along the hand grip portion whereby the trigger arm can be squeezed toward the hand grip portion to drive the actuator arm against the plunger head. The shell portion serves as a receptacle in which the aerosol can is secured, and as a shield for isolating the hand and fingers from exposure to the aerosol spray. A quick release fastener assembly is carried by the shell portion for securing the aerosol container in a stable upright operating position within the shell.

In the preferred embodiment, the shell portion is a cylindrical sidewall segment having an annular formed along its inside surface. The annular groove receives the annular sealing rim of the aerosol container in detented engagement. A shroud panel interconnects the shell portion and the trigger housing and shields the hand grip with respect to the aerosol spray discharge.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DETAILED DESCRIPTION OF THE PREFERRED EMBODIMENT

Figure 1:
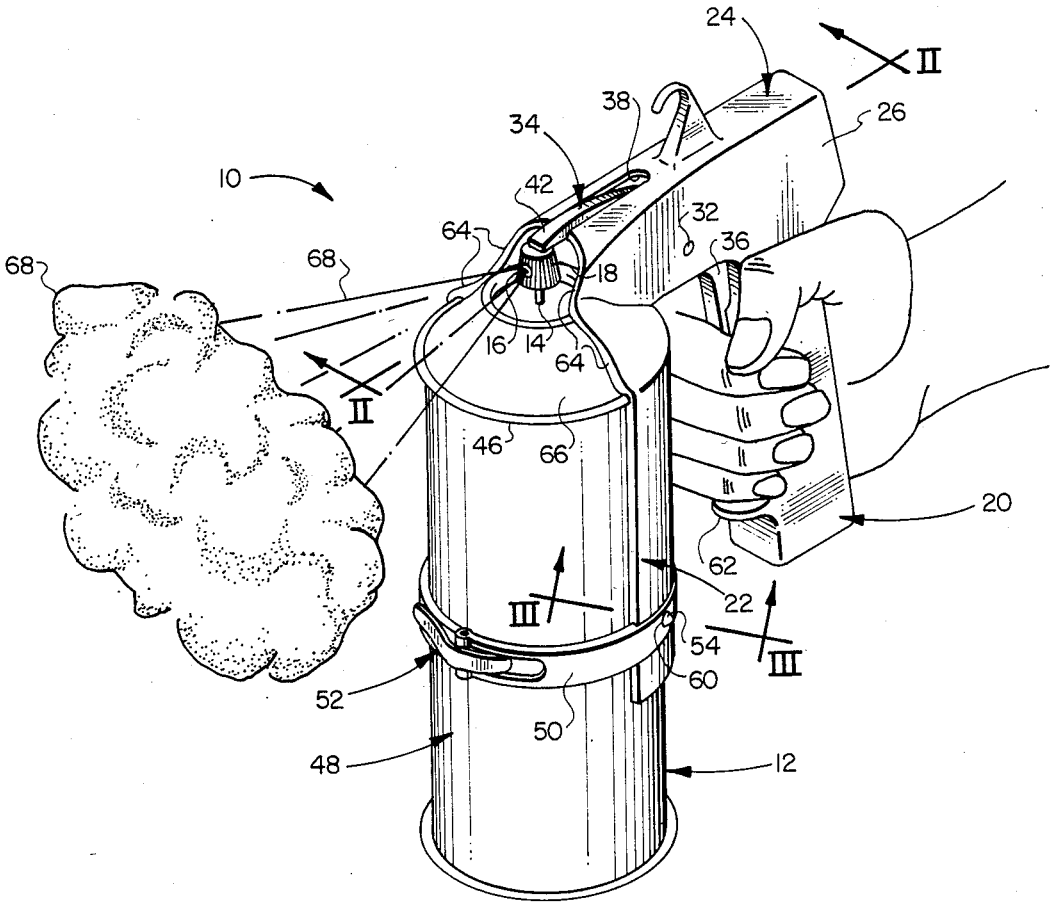
FIG. 1 is a perspective view which illustrates the attachment of an aerosol can to the operating handle of the invention.

In the description which follows, like parts are marked throughout the specification and drawings with the same reference numerals, respectively. The drawings are not necessarily to scale and in some instances proporations have been exaggerated in order to more clearly depict certain features of the invention.

Figure 2:
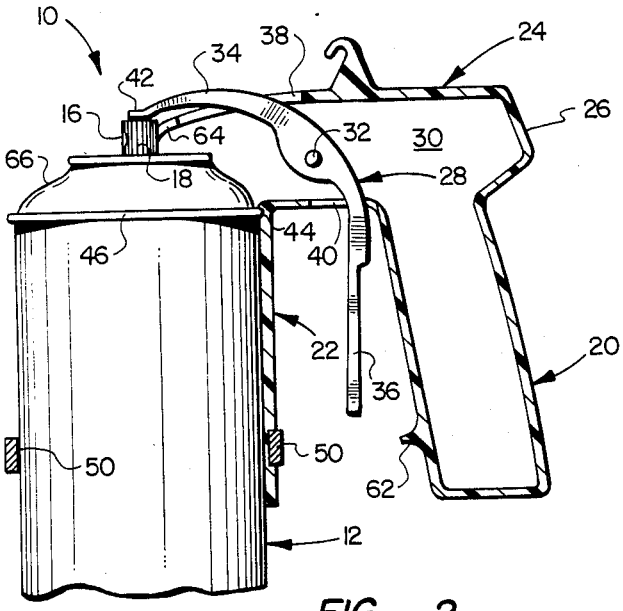
FIG. 2 is a sectional view, partly in elevation, and partly broken away, taken along the lines II—II of FIG. 1.

Referring now to FIGS. 1 and 2, an operating handle assembly 10 is shown in combination with a conventional aerosol spray container of the type commonly used to dispense paint, hair preparations, insecticides, herbicides, disinfectants and the like. The aerosol spray container 12 is a sealed cylinder which contains pressurized propellant and an active ingredient. The pressurized mixture is discharged through a movable plunger tube 14 which is carried by a plunger head 18. According to the usual method of dispensing spray material from this type of aerosol container, the aerosol container is held in one hand with the forefinger of that hand being applied against the plunger head. This is an uncomfortable, awkward position to maintain over an extended duration, and it exposes the hand and fingers to direct contact with the aerosol spray.

The operating handle assembly 10 includes a hand grip portion 20, a shell portion 22 and a trigger assembly 24 interconnecting the hand grip portion 20 with the shell portion 22. The trigger assembly 24 includes a trigger housing 26 and an actuator 28. As can be seen in FIG. 2, the trigger housing 26 encloses a hollow space 30. The actuator 28 is received within the hollow space 30 and is mounted for pivotal movement on a pin 32.

The actuator 28 comprises an actuator arm 34 and a trigger arm 36. The trigger arm 36 is angularly offset with respect to the actuator arm 34 whereby movement of the trigger arm toward the hand grip 20 causes a counterclockwise movement of the actuator arm 34 downwardly against the plunger head 18. Narrow slots 38, 40 are formed in the trigger housing 26 to allow free movement of the actuator 34 and trigger arm 36.

The actuator arm 34 projects through the slot 38 and out of the trigger housing 26. The terminal portion of the actuator arm 34 is provided with a pad portion 42 which is aligned with the plunger head 18.

In an alternate mounting arrangement (not illustrated), the actuator is rigidly attached to the pivot pin 32, with the ends of the pivot pin 32 defining trunnions, and with the trunnions being rotatably received within sockets formed within the sidewalls of the trigger housing 26.

Figure 4:
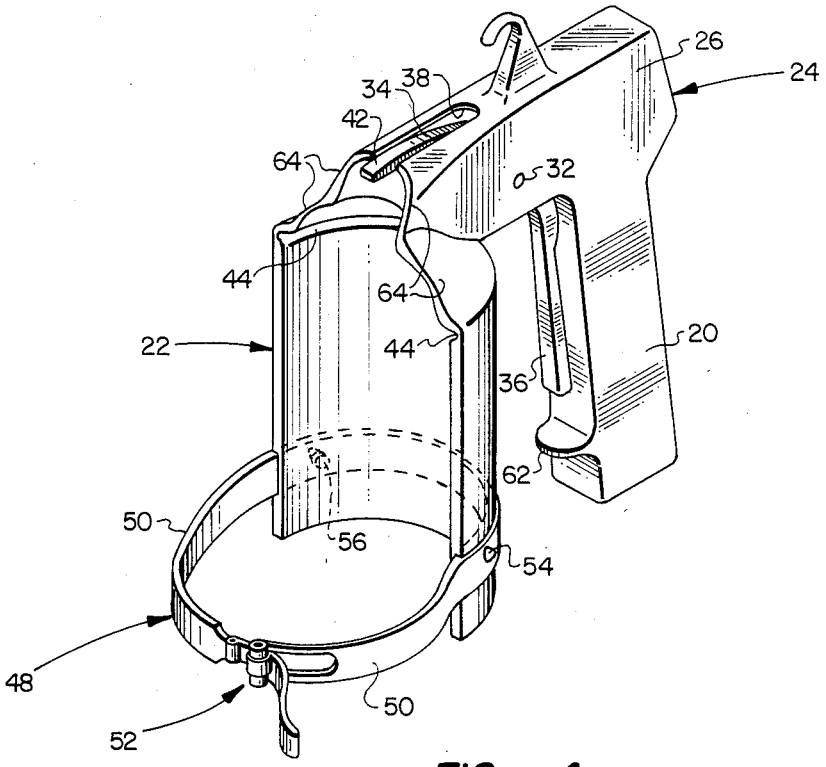
FIG. 4 is a perspective view of an operating handle assembly from which the aerosol container has been removed; and, FIG. 5 is an elevation view of the aerosol container mounted within the operating handle of the invention.
Figure 5:
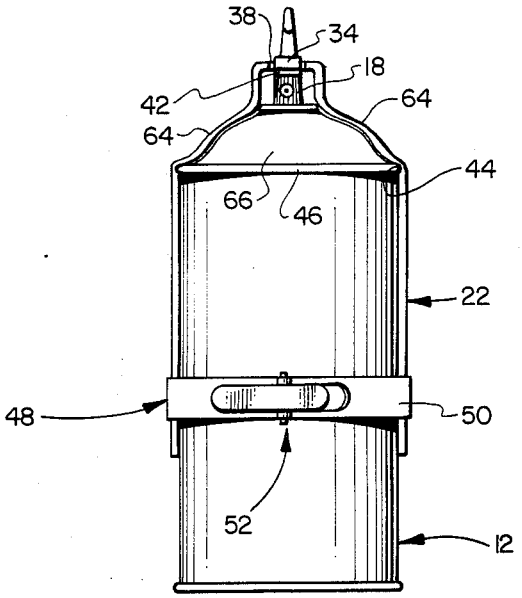

Referring now to FIGS. 2, 4 and 5, the shell 22 is a segment of a cylindrical sidewall and has a height which is slightly in excess of one-half of the height of the aerosol container 12. An annular groove 44 is formed along the inside surface of the shell. The purpose of the annular groove 44 is to receive the radially projecting sealing rim 46 which is found on most aerosol containers. The annular rim 46 is received in detented engagement within the annular groove 44 to prevent vertical displacement of the aerosol can 12 after the aerosol container has been placed in the operating position as shown in FIG. 1. This prevents the position of the aerosol container from being disturbed as a result of pressure applied through the actuator arm 34 or as a result of manual shaking movements imparted to the can through the hand grip 20 and trigger housing 26.

Figure 3:
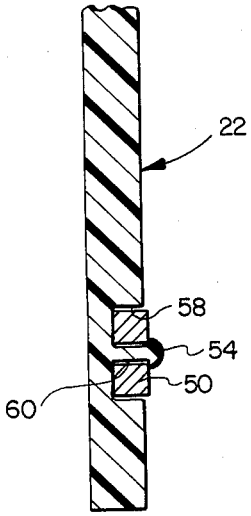
FIG. 3 is a sectional view of the container sidewall and fastener assembly taken along the line III—III of FIG. 1.

Referring now to FIGS. 1, 3 and 4, the aerosol container 12 is secured into the operating position by a band clamp assembly 48. The band clamp assembly 48 includes a flexible band 50 whose ends are coupled together by a quick release overcenter coupling 52. The band clamp assembly 48 is coupled to the lower end of the shell 22 by studs 54, 56. Preferably, a rectangular slot 58 is formed in the exterior surface of the shell 22, and the studs 54, 56 are located within the slot and project radially outwardly. An eyelet 60 is formed within the flexible band 50 and captures the stud 54 in an interference coupling fit.

The quick release overcenter coupling fastener 52 provides tight, compressive engagement with the cylindrical sidewall of the aerosol container 12. The frictional, compressive engagement of the band clamp assembly with the cylindrical surface of the aerosol container in combination with the detented engagement of the annular sealing rim 46 within the annular groove 44 stabilizes the aerosol container 12 and secures it firmly against the shell 22. Thus, its aligned operating position will be maintained during operation, and will also be maintained in secure engagement against the shell to permit the can to be shaken without risk of detachment.

It is necessary to shake the contents of the aerosol container, from time to time, to ensure that the active ingredient is thoroughly mixed with the propellant. A finger rest 62 is formed along the inside lower end of the hand grip which prevents slipping or sliding movement of the hand along the grip 20 when the aerosol container is being shaken.

It is apparent that the aerosol container 12 can be quickly inserted into the shell 22 and clamped rigidly into its operating position within the shell, and that the aerosol container can just as easily be removed by releasing the overcenter toggle fastener 52 and allowing the aerosol container to drop downwardly out of the shell 22.

According to an important feature of the invention, the shell 22 is coupled to the trigger housing 26 by a shroud panel 64. As can best be seen in FIGS. 1 and 5, the shroud panel 64 is curved and conforms generally with the curvature of the neck panel 66 which forms the upper end of the aerosol container 12. The shroud panel 64 and shell 22 are operable, in combination, for shielding the hand grip 20 with respect to the pressurized aerosol spray 68 which is discharged through the spray jet 16.

The trigger arm portion 36 of the actuator 28 extends downwardly through the slot 40 and alongside the hand grip 20. As can be seen in FIG. 1, the entire hand may be curled around the hand grip 20 and trigger arm 36 in a comfortable, natural position. According to this arrangement, the handle assembly can be operated over a long application period without finger cramps or discomfort. Additionally, the operating handle assembly 10 is relatively lightweight and is balanced in combination with the aerosol container 12 whereby the operator can apply the aersol spray uniformly in sweeping motions. Additionally, because of the grip of the clamp assembly, the wide operating range of the actuator arm 34, and because of the placement of the annular groove detent structure near the upper end of the shell 22, the handle assembly can accomodate aerosol spray containers of different sizes. Moreover, the spray containers can be attached, operated and released without the use of tools.

The operating handle assembly 10 is preferably constructed of a lighweight, high strength, durable material such as aluminium or a synthetic polymer material.

The foregoing preferred embodiment of the invention has been shown and described herein for purposes of illustration only. Various changes in the structure as illustrated will no doubt occur to those skilled in the art. Such changes should be understood as being comprehended by the invention insofar as such changes fall within the spirit and scope of the appended claims.

What is claimed is:

1. An operating handle for an aerosol container of the type having a tubular sidewall and a plunger head coupled to a dispensing valve for releasing pressurized contents of the aerosol container through a spray jet in response to displacement of the plunger head, said operating handle assembly comprising a hand grip portion, a trigger housing portion connected to the hand grip portion, said trigger housing having an interior chamber for receiving a trigger assembly; a trigger assembly disposed within the interior chamber of said trigger housing, said trigger assembly being pivotally coupled to said trigger housing, and said trigger assembly including an actuator arm for engaging the plunger head of an aerosol container and having a trigger arm projecting externally of said trigger housing and extending along said hand grip portion whereby said trigger arm can be squeezed toward the hand grip portion; a shell portion connected to and depending from said trigger housing, said shell portion being semi-cylindrical and conformed for surface engagement with a portion of the cylindrical sidewall of an aerosol container; fastening means carried by said shell portion for securing an aerosol container in an upright position within said shell with its plunger head aligned for engagement by said actuator arm; and a shroud panel interconnecting said shell portion and, said trigger housing, said shroud panel and said shell portion being operable, in combination, for shielding said hand grip portion with respect to pressurized aerosol spray discharged through a spray jet.

2. An operating handle for an aerosol container of the type having a tubular sidewall, a neck panel portion sealing one end of said aerosol container, and a plunger head extending through said neck panel portion and coupled to a dispensing valve for releasing pressurized contents of the aerosol container through a spray jet in response to displacement of the plunger head, the union of said neck panel portion and said cylindrical sidewall defining a radially projecting rim, said operating handle assembly comprising a hand grip portion, a trigger housing connected to the hand grip portion, said trigger housing having an interior chamber for receiving a trigger assembly; a trigger assembly disposed within the interior chamber of said trigger housing, said trigger assembly being pivotally coupled to said trigger housing, and said trigger assembly including an actuator arm for engaging the plunger head of an aerosol container and having a trigger arm projecting externally of said trigger housing and extending along the hand grip portion whereby said trigger arm can be squeezed toward the hand grip portion; a shell connected to and depending from said trigger housing, said shell having a curved sidewall and an annular groove formed along the inside surface of said curved sidewall segment, said shell portion being semi-cylindrical and conformed for surface engagement with a portion of the cylindrical sidewall of an aerosol container; fastening means carried by said shell for securing an aerosol container in an operational position within said shell wherein said annular rim is received in detented engagement with said annular groove; and, a shroud panel interconnecting said shell and said trigger housing, said shroud panel and said shell being operable, in combination, for shielding said hand grip portion with respect to pressurized aerosol spray discharged through a spray jet.

3. An operating handle for an aerosol container of the type having a tubular sidewall and a plunger head coupled to a dispensing valve for releasing the pressurized contents of the aerosol container through a spray jet in response to displacement of the plunger head, said operating handle assembly comprising a hand grip portion, a trigger housing connected to the hand grip portion, said trigger housing having an interior chamber for receiving a trigger assembly; a trigger assembly disposed within the interior chamber of the trigger housing, said trigger assembly being pivotally coupled to said trigger housing, and said trigger assembly including an actuator arm for engaging the plunger head of an aerosol container and having a trigger arm projecting externally of the trigger housing and extending along said hand grip portion whereby said trigger arm can be squeezed toward the hand grip portion; a shell connected to and depending from said trigger housing; fastening means carried by said shell for securing an aerosol container in an operational position within said shell wherein its plunger head is aligned for engagement with said actuator arm; and, a shroud panel interconnecting said shell and said trigger housing, said shroud panel and said shell being operable, in combination, for shielding said hand grip with respect to the pressurized aerosol spray discharged through said spray jet.

* * * * *